US008864006B1

(12) United States Patent
Page

(10) Patent No.: US 8,864,006 B1
(45) Date of Patent: Oct. 21, 2014

(54) CONTAINER PUNCTURING DEVICE

(76) Inventor: James H. Page, Bottineau, ND (US)

( * ) Notice: Subject to any disclaimer, the term of this patent is extended or adjusted under 35 U.S.C. 154(b) by 316 days.

(21) Appl. No.: 13/584,189

(22) Filed: Aug. 13, 2012

(51) Int. Cl.
*B26F 1/18* (2006.01)

(52) U.S. Cl.
USPC ..... 225/6; 83/660

(58) Field of Classification Search
USPC ..... 83/928, 660; 30/2; 225/6, 93, 91
See application file for complete search history.

(56) References Cited

U.S. PATENT DOCUMENTS

| | | | | | |
|---|---|---|---|---|---|
| 2,131,651 | A * | 9/1938 | Jack Woo | 222/448 |
| 2,425,524 | A * | 8/1947 | Dooley et al. | 366/106 |
| 3,883,015 | A * | 5/1975 | Gorby | 414/723 |
| 3,925,962 | A * | 12/1975 | Knopf et al. | 53/527 |
| 4,531,883 | A * | 7/1985 | Arnold | 414/722 |
| 5,016,353 | A * | 5/1991 | Iten | 30/124 |
| 5,135,146 | A * | 8/1992 | Simhaee | 225/80 |
| 5,146,848 | A * | 9/1992 | Dufour | 100/345 |
| 5,303,998 | A * | 4/1994 | Whitlatch et al. | 366/3 |
| 5,899,372 | A * | 5/1999 | Rodriguez | 225/1 |
| 6,439,279 | B1 * | 8/2002 | Underwood | 144/34.6 |
| 6,968,877 | B1 * | 11/2005 | Stokkeland | 144/4.1 |
| 7,730,620 | B1 * | 6/2010 | Anastasi | 30/294 |
| 8,528,843 | B2 * | 9/2013 | Murphy | 241/30 |
| 2002/0124700 | A1 * | 9/2002 | Aulson | 83/53 |
| 2005/0102844 | A1 * | 5/2005 | Addis | 30/299 |
| 2008/0257449 | A1 * | 10/2008 | Weinstein et al. | 141/67 |
| 2010/0242701 | A1 * | 9/2010 | Tajiri et al. | 83/660 |
| 2012/0317932 | A1 * | 12/2012 | Dunivan et al. | 53/491 |

* cited by examiner

*Primary Examiner* — Sean Michalski
(74) *Attorney, Agent, or Firm* — Jason L. Gilbert

(57) ABSTRACT

A container puncturing device for efficiently and safely emptying the contents of a container into a storage tank or other structure. The container puncturing device generally includes a cross bar having a pair of tank attachment assemblies, a pair of bucket attachment assemblies and a puncturing member secured thereto. The bucket attachment assemblies are adapted to allow the present invention to be lifted and moved by a loader bucket such as one attached to a skid steer loader. The tank attachment assemblies are utilized to secure the present invention to the upper end of a tank. When a container is lowered onto the puncturing member, any particulate materials stored therein will be dispensed into the tank through the punctured opening. The present invention may then be lifted off and away from the tank through use of the bucket attachment assemblies and a loader bucket.

20 Claims, 8 Drawing Sheets

CONTAINER PUNCTURING DEVICE

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a container puncturing device and more specifically it relates to a container puncturing device for efficiently and safely emptying the contents of a container into a storage tank or other structure.

2. Description of the Related Art

Any discussion of the related art throughout the specification should in no way be considered as an admission that such related art is widely known or forms part of common general knowledge in the field.

Large containers of particulate matter are often delivered to construction sites and other locations for use in operations. For example, in oil drilling rigs, large containers of fly ash are routinely delivered for use in mixing with oil well drill cuttings, such as shale bits and the like. In the past, these containers have been lifted over a tank and then cut open by hand, such as by a worker with a knife.

The manual opening of such containers to dispense their contents into a tank has traditionally been a dangerous operation. A worker is often required to stand under an extremely heavy container of material which, if dislodged from the structure lifting it, can fall on the worker and cause serious injury or death. Further, when cutting open such a container from the bottom, the worker is often exposed to the material being dispensed.

Because of the inherent problems with the related art, there is a need for a new and improved container puncturing device for efficiently and safely emptying the contents of a container into a storage tank or other structure.

BRIEF SUMMARY OF THE INVENTION

The invention generally relates to a container puncturing device which includes a cross bar having a pair of tank attachment assemblies, a pair of bucket attachment assemblies and a puncturing member secured thereto. The bucket attachment assemblies are adapted to allow the present invention to be lifted and moved by a loader bucket such as one attached to a skid steer loader. The tank attachment assemblies are utilized to secure the present invention to the upper end of a tank. When a container is lowered onto the puncturing member, any particulate materials stored therein will be dispensed into the tank through the punctured opening. The present invention may then be lifted off and away from the tank through use of the bucket attachment assemblies and a loader bucket.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjuncton with the accompanying drawings, in which like reference characters designate the same or similar parts throughout the several views, and wherein.

DETAILED DESCRIPTION OF THE INVENTION

A. Overview

Figure 1:
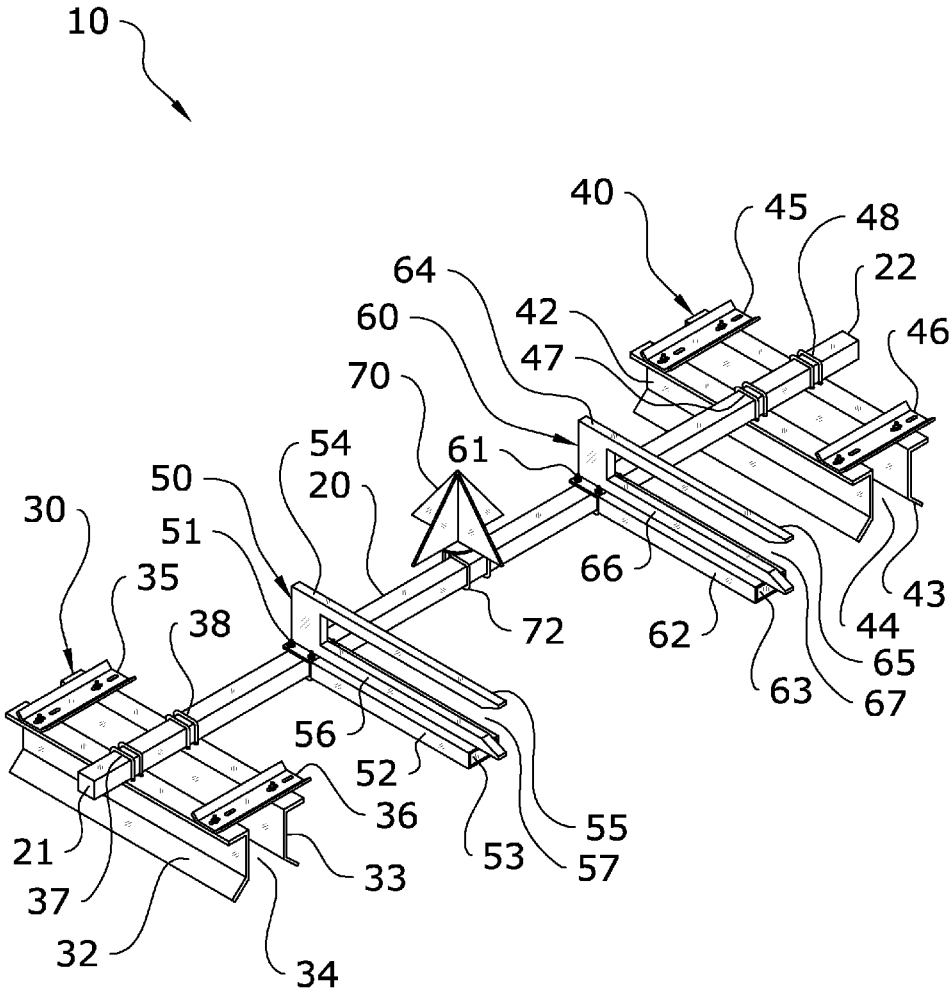
FIG. 1 is an upper perspective view of the present invention.

Turning now descriptively to the drawings, in which similar reference characters denote similar elements throughout the several views, FIGS. 1 through 8 illustrate a container puncturing device 10, which comprises a cross bar 20 having a pair of tank attachment assemblies 30, 40, a pair of bucket attachment assemblies 50, 60 and a puncturing member 70 secured thereto. The bucket attachment assemblies 50, 60 are adapted to allow the present invention to be lifted and moved by a loader bucket 16 such as one attached to a skid steer loader. The tank attachment assemblies 30, 40 are utilized to secure the present invention to the upper end of a tank 18. When a container 12 is lowered onto the puncturing member 70, any particulate materials 13 stored therein will be dispensed into the tank 18 through the punctured opening. The present invention may then be lifted off and away from the tank 18 through use of the bucket attachment assemblies 50, 60 and a loader bucket 16.

B. Cross Bar

As shown in FIG. 1, the present invention generally includes a cross bar 20 having a first end 21 and a second end 22. The cross bar 20 is comprised of an elongated member to which the tank and bucket attachment assemblies 30, 40, 50, 60 and puncturing member 70 are secured.

It should be appreciated that the size and configuration of the cross bar 20 will vary for different applications (i.e. differently sized loader buckets 16 and/or tanks 18). Further, the material and configuration of the cross bar 20 may vary in different embodiments. Thus, the scope of the present invention should not be construed as being limited by the exemplary figures.

C. Tank Attachment Assemblies

Figure 3:
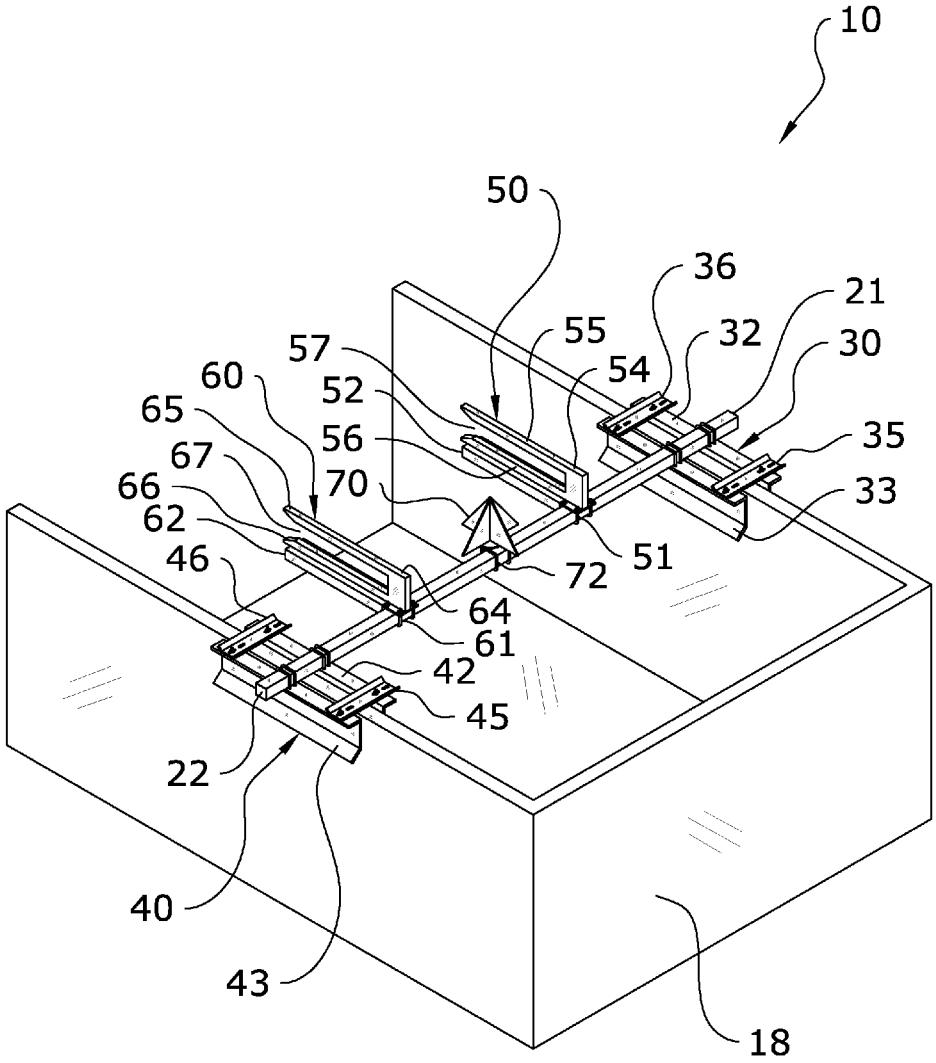
FIG. 3 is an upper perspective view of the present invention positioned over a tank.

As shown in the figures, the present invention generally includes a pair of tank attachment assemblies 30, 40 which are utilized to secure the present invention over the side walls of a storage tank 18 as shown in FIG. 3. Generally, a first tank attachment assembly 30 will be secured adjacent a first end 21 of the cross bar 20 and a second tank attachment assembly 40 will be secured adjacent a second end 22 of the cross bar 20.

As best shown in FIG. 1, the first tank attachment assembly 30 is comprised of a pair of side members 32, 34 which define a first channel 34 in which a side wall of a tank 18 will be secured when the present invention is in use. The first and second side members 32, 34 each extend perpendicularly with respect to the cross bar 20 and are horizontally offset from each other to form the channel 34. The horizontal offset, and the thus the width of the channel 34, may vary for different embodiments and thus should not be construed as being limited by the exemplary figures.

The side members 32, 34 are secured to each other via a pair of cross members 35, 36 as best shown in FIG. 1. Each of the cross members 35, 36 is comprised of an elongated member which extends from the first side member 32 to the second side member 33 of the first tank attachment assembly 30. The cross members 35, 36 extend perpendicularly with respect to the side members 32, 33 and parallel with respect to the cross bar 20.

The cross members 35, 36 may include multiple apertures thereon as shown in FIG. 1 to allow for easy repositioning of the cross members 35, 36 with respect to each other so as to be able to vary the width of the channel 34 for different tank side wall configurations and sizes.

Figure 6:
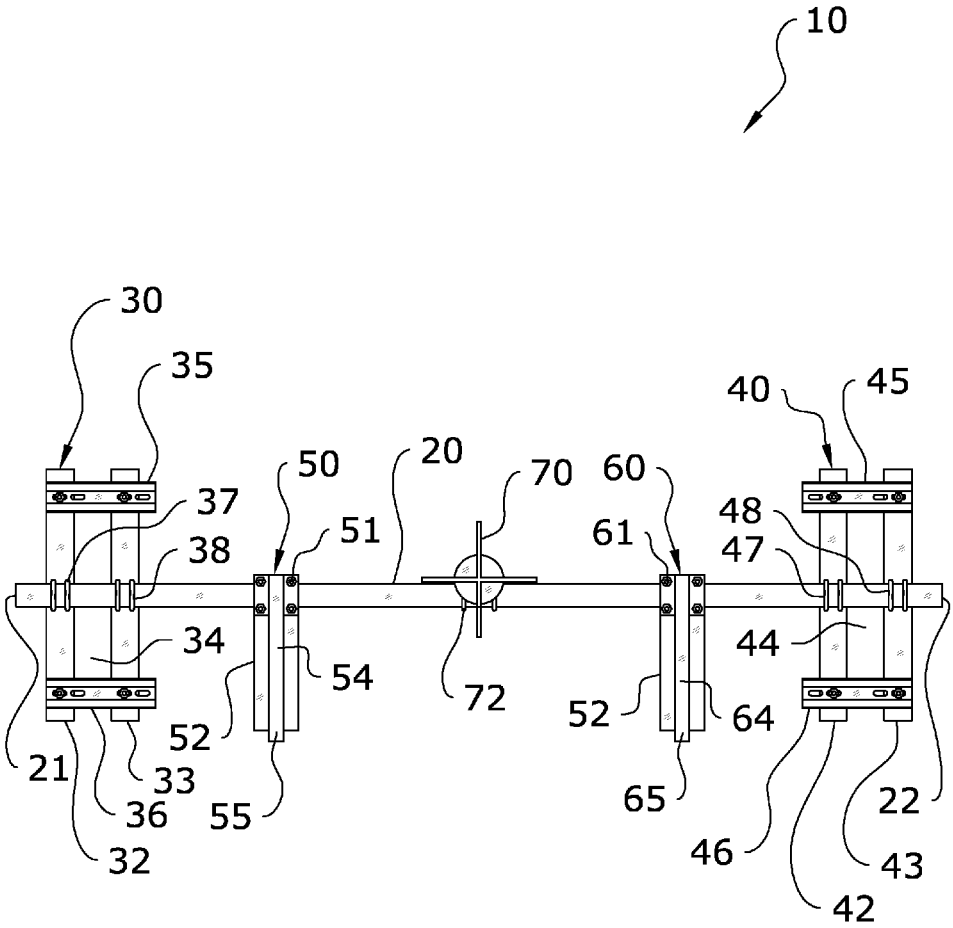
FIG. 6 is a top view of the present invention.
Figure 7:
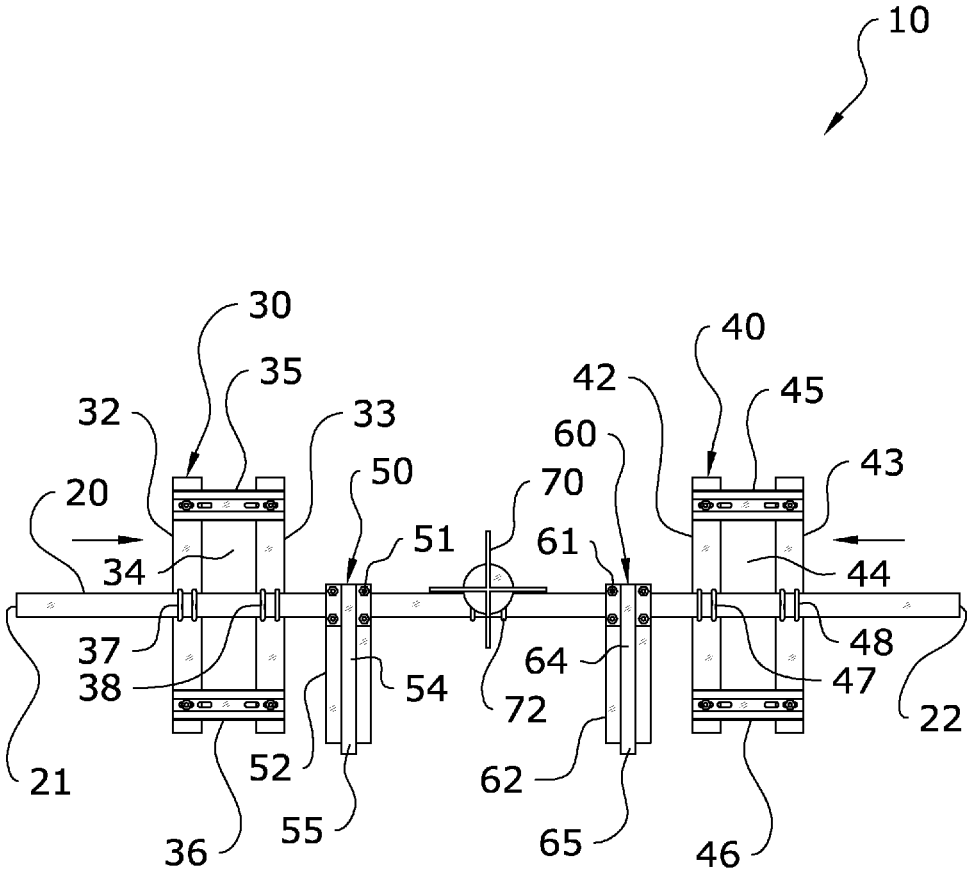
FIG. 7 is a top view of the present invention illustrating repositioning of the tank attachment assemblies.

The cross members 35, 36 are secured to the cross bar 20 via one or more adjustment members 37, 38. The adjustment members 37, 38 are generally comprised of brackets, tie-downs or other structures which are capable of secured a first elongated structure to a second, perpendicular elongated structure. In a preferred embodiment, the adjustment members 37, 38 will be easily removable so as to be able to adjust the positioning of the side members 32, 33 with respect to the cross bar 20 as best illustrated in FIGS. 6 and 7.

As best shown in FIG. 1, the second tank attachment assembly 40 is comprised of a pair of side members 32, 34 which define a second channel 44 in which a side wall of a tank 18 will be secured when the present invention is in use. The first and second side members 42, 44 each extend perpendicularly with respect to the cross bar 20 and are horizontally offset from each other to form the channel 44. The horizontal offset, and the thus the width of the channel 44, may vary for different embodiments and thus should not be construed as being limited by the exemplary figures.

The side members 42, 44 are secured to each other via a pair of cross members 45, 46 as best shown in FIG. 1. Each of the cross members 45, 46 is comprised of an elongated member which extends from the first side member 42 to the second side member 43 of the second tank attachment assembly 40. The cross members 45, 46 extend perpendicularly with respect to the side members 42, 43 and parallel with respect to the cross bar 20.

The cross members 45, 46 may include multiple apertures thereon as shown in FIG. 1 to allow for easy repositioning of the cross members 45, 46 with respect to each other so as to be able to vary the width of the channel 44 for different tank side wall configurations and sizes.

The cross members 45, 46 are secured to the cross bar 20 via one or more adjustment members 47, 48. The adjustment members 47, 48 are generally comprised of brackets, tie-downs or other structures which are capable of secured a first elongated structure to a second, perpendicular elongated structure. In a preferred embodiment, the adjustment members 47, 48 will be easily removable so as to be able to adjust the positioning of the side members 42, 43 with respect to the cross bar 20 as best illustrated in FIGS. 6 and 7.

Figure 8:
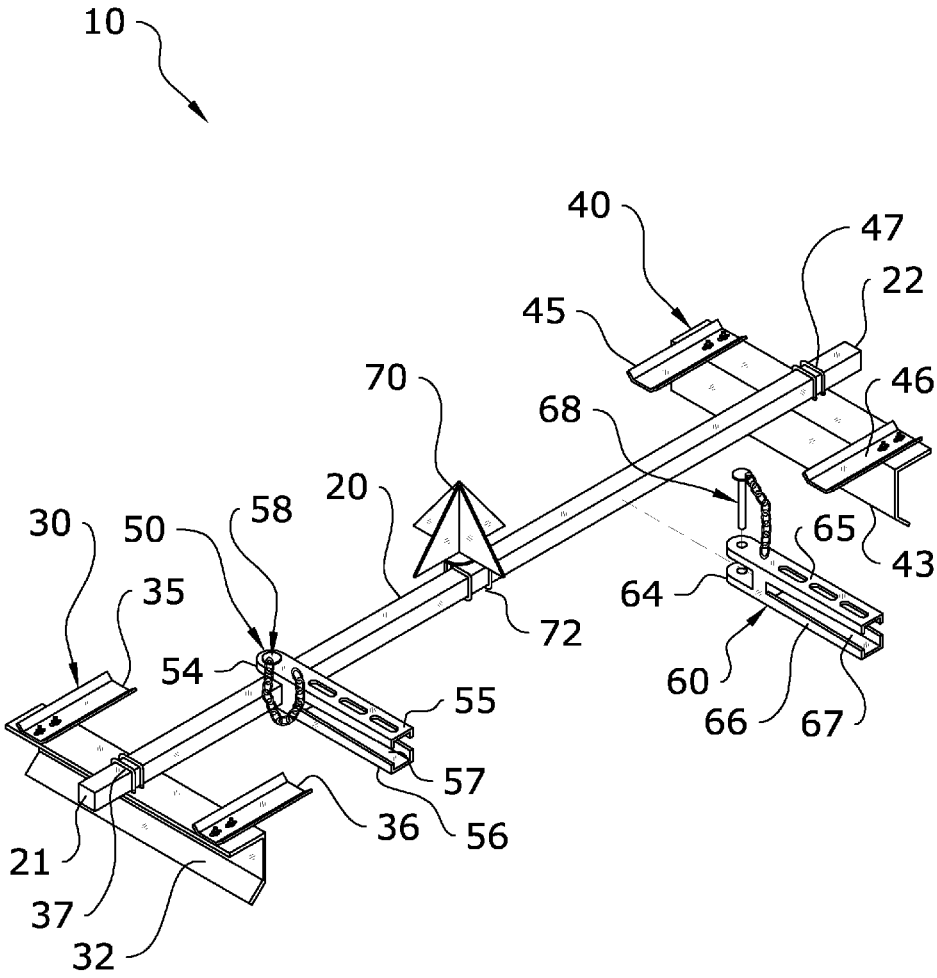
FIG. 8 is an upper perspective view of an alternate embodiment of the present invention.

As shown in FIG. 8, some embodiments of the present invention may omit usage of the second side members 33, 43 of the respective tank attachment assemblies 20, 30. While such a configuration may be slightly less secure in its attachment to a tank 18, it eases installation and requires usage of less materials.

D. Bucket Attachment Assemblies

Due to the weight of the present invention, it is necessary to use machinery to lift the container puncturing device 10 in place over a tank. As best shown in FIG. 1, the present invention includes a pair of bucket attachment assemblies 50, 60 which are utilized to secure the present invention to a loader bucket 16 so that it may be easily installed or removed from a tank 18.

Generally, a first bucket attachment assembly 50 will be secured to the cross bar 20 between the first tank attachment assembly 30 and the puncturing member 70. Similarly, the second bucket attachment assembly 60 will be secured to the cross bar 20 between the puncturing member 70 and the second tank attachment assembly 40. As described herein, the bucket attachment assemblies 50, 60 are preferably removably secured to the cross bar 20 to allow for easy reconfiguration for different loader bucket 16 configurations.

As best shown in FIG. 1, the first bucket attachment assembly 50 includes a fork tine receiver 52 which is secured to the cross bar 20 of the present invention via an attachment bracket 51. The structure and configuration of the attachment bracket 51 may vary; the bucket attachment assemblies 50 may be fixedly or removably secured to the cross bar 20. The fork tine receiver 52 is comprised of an elongated member which includes a frontal opening 53 leading to an internal cavity. The fork tine receiver 52 is adapted to removably receive a fork tine of a loader bucket 16.

Figure 2:
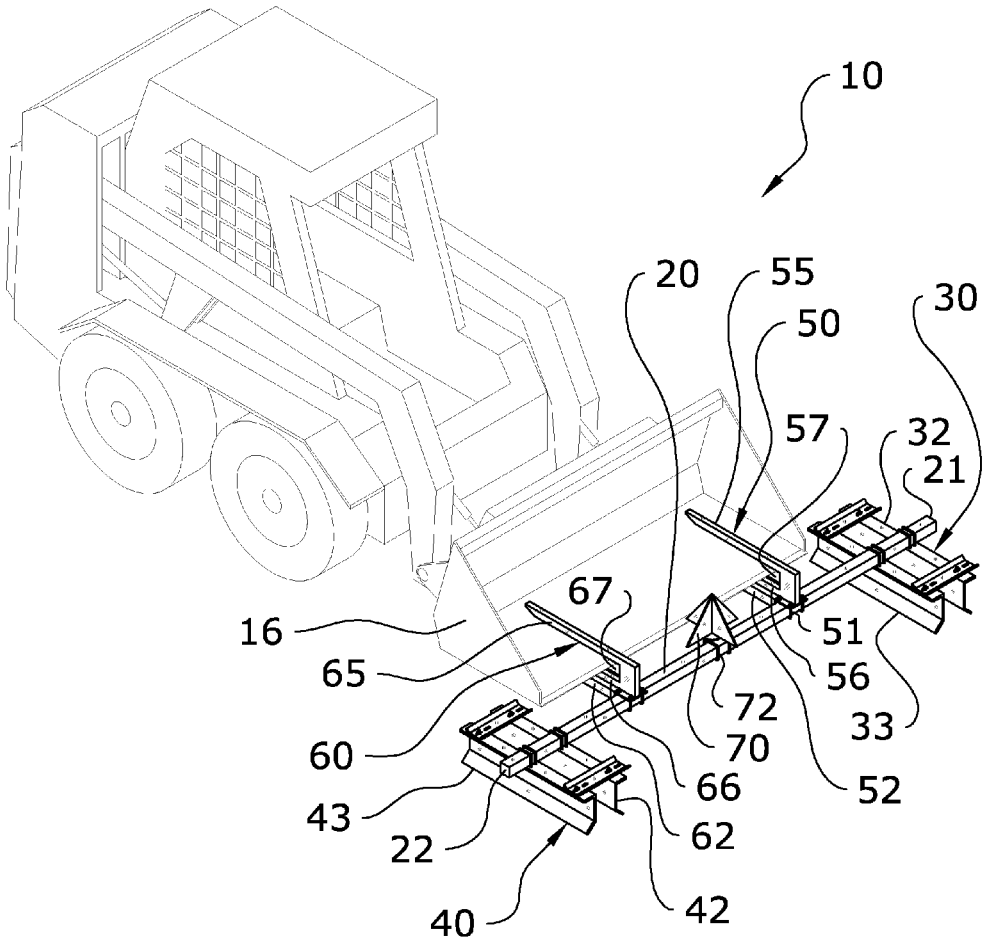
FIG. 2 is an upper perspective view of the present invention positioned on a loader bucket.

The first bucket attachment assembly 50 also includes a first bucket attachment 54 which is comprised of an upper member 55 and a lower member 56, each of which are preferably elongated, which extend parallel to each other and perpendicular with respect to the cross bar 20. A first bucket slot 57 is defined by the upper and lower members 55, 56, wherein the first bucket slot 57 is adapted to removably receive a portion of a loader bucket 16 as shown in FIG. 2.

As best shown in FIG. 1, the second bucket attachment assembly 60 includes a fork tine receiver 62 which is secured to the cross bar 20 of the present invention via an attachment bracket 61. The structure and configuration of the attachment bracket 61 may vary; the bucket attachment assemblies 50 may be fixedly or removably secured to the cross bar 20. The fork tine receiver 62 is comprised of an elongated member which includes a frontal opening 63 leading to an internal cavity. The fork tine receiver 62 is adapted to removably receive a fork tine of a loader bucket 16.

The second bucket attachment assembly 60 also includes a second bucket attachment 64 which is comprised of an upper member 65 and a lower member 66, each of which are preferably elongated, which extend parallel to each other and perpendicular with respect to the cross bar 20. A first bucket slot 67 is defined by the upper and lower members 65, 66, wherein the first bucket slot 67 is adapted to removably receive a portion of a loader bucket 16 as shown in FIG. 2.

As shown in FIG. 8, in an alternate embodiment of the present invention, a pair of locking assemblies 58, 68 may be utilized to removably secure the bucket attachment assemblies 50, 60 to the cross bar 20. The locking assemblies 58, 68 may each be comprised of a locking pin which is secured to the locking assembly 58, 68 via a chain. The locking pin may be positioned within an aperture extending through an end of the each bucket attachment assembly 50, 60 to secure to the cross bar 20.

E. Puncturing Member

As shown in FIG. 1, the present invention includes a puncturing member 70 which is adapted to puncture a container 12 when the container 12 is lowered thereon. The puncturing member 70 may be comprised of various configurations which are capable of efficiently puncturing a container 12 so as to allow it to dispense particular material 13 through the punctured opening and into a tank 18 as shown in FIGS. 4 and 5.

Figure 4:
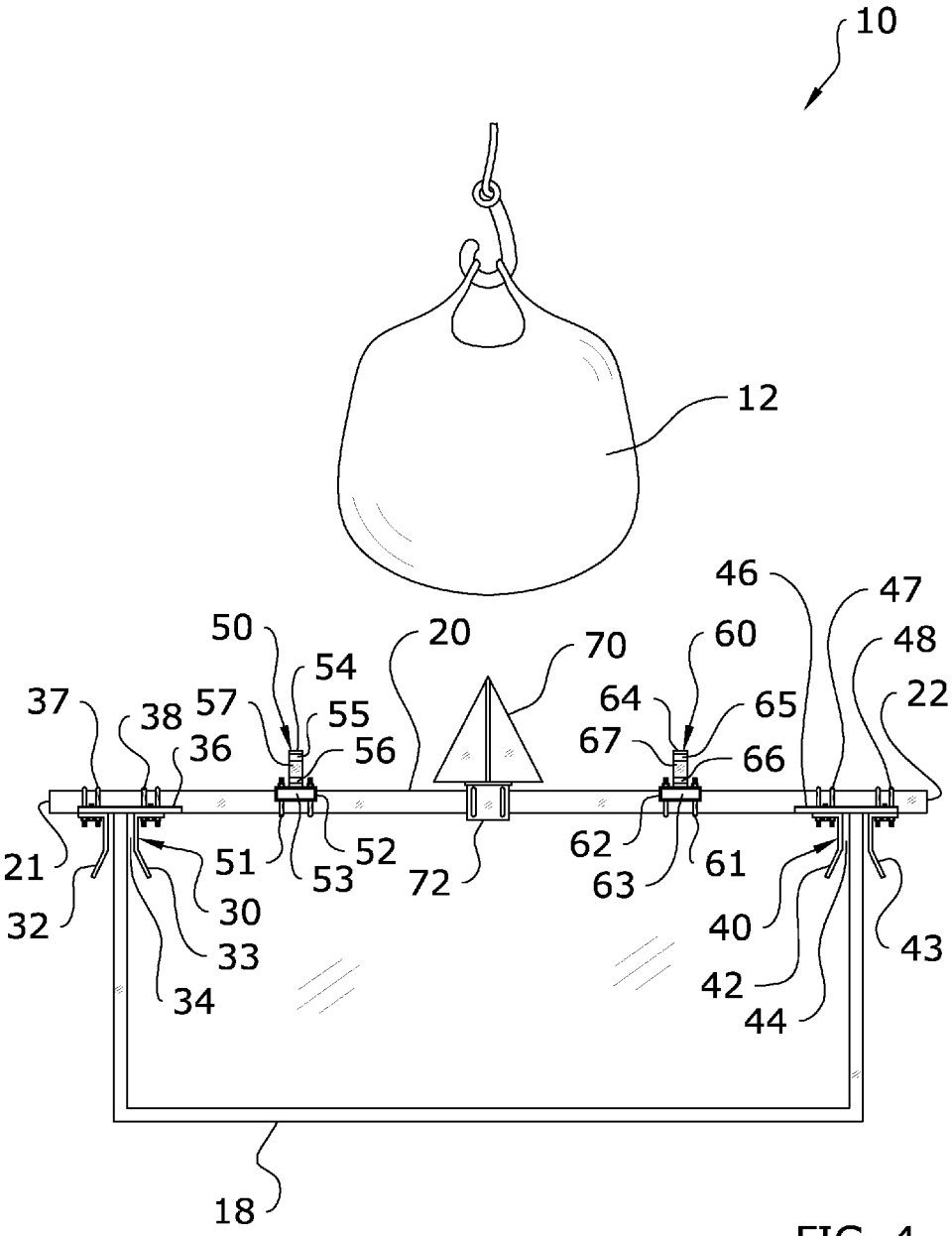
FIG. 4 is a frontal view of a container being lowered onto the present invention.
Figure 5:
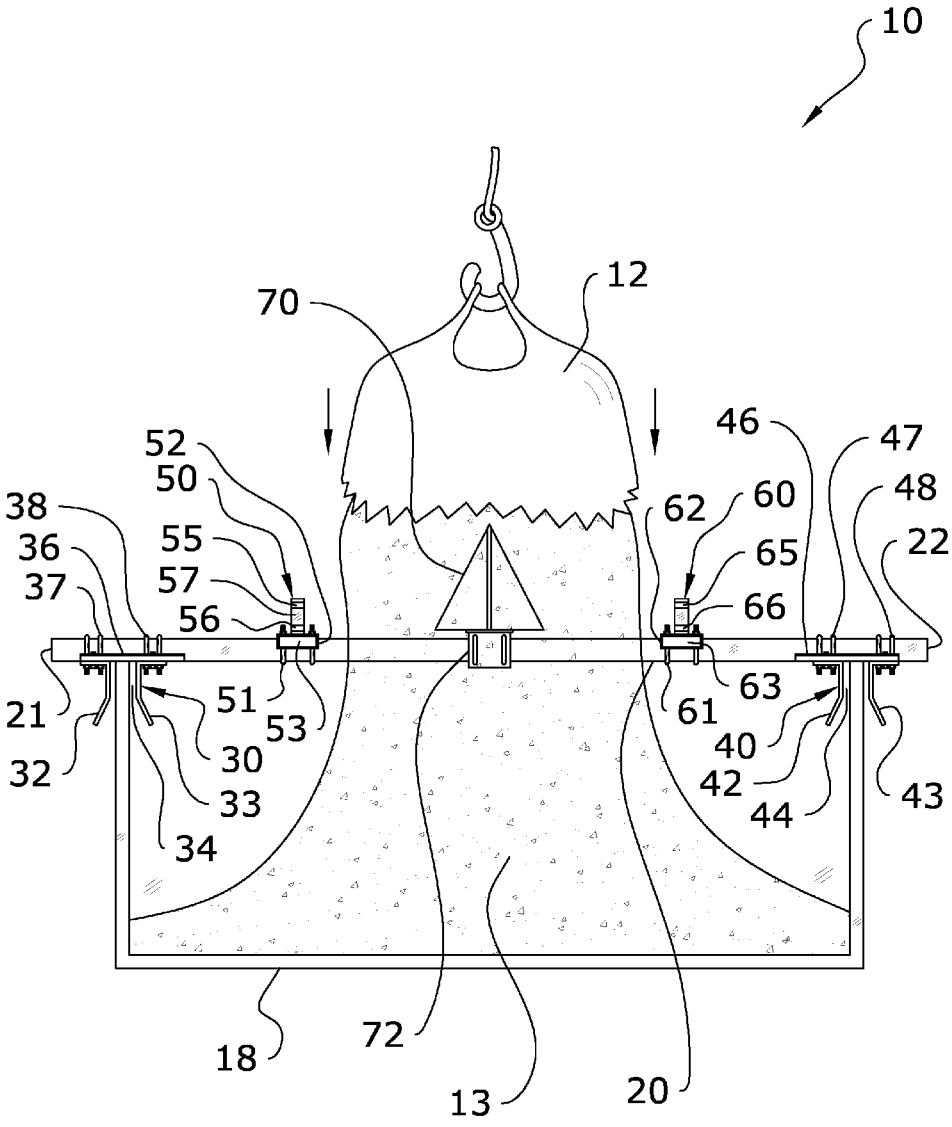
FIG. 5 is a frontal view of a container being punctured by the present invention to dispense particulate material.

In a preferred embodiment as shown in FIGS. 1, 4 and 5, the puncturing member 70 will be comprised of four triangular-shaped blades which are configured to converge at a single point at their respective upper ends. Thus, the overall appearance of the puncturing member 70 in a preferred embodiment will resemble that of a tree or pyramid. The puncturing member 70 may be fixedly or removably secured to the cross bar 20 via an attachment member 72. The attachment member 72 may be comprised of any structure capable of efficiently securing the puncturing member 70 to the cross bar 20.

F. Operation of Preferred Embodiment

In use, the present invention is first lifted by a loader bucket 16 by positioning the loader bucket 16 into the bucket slots 57, 67 of the bucket attachment assemblies 50, 60 as shown in FIG. 2. The present invention is then moved by the loader into a position overhead the tank 18 in which the particular matter 13 will be dispensed from the punctured container 12.

The present invention may now be lowered onto the tank 18 as shown in FIG. 3. The first channel 34 of the first tank attachment assembly 30 is positioned over the first side wall of the tank 18 and the second channel 44 of the second tank attachment assembly 40 is positioned over the second side wall of the tank 18 so that the cross bar 20 extends over the opening of the tank 18 as shown in FIG. 3. The bucket 16 may then be retracted from within the bucket attachment assemblies 50, 60.

With the present invention position over the tank 18, a container 12 may be lifted and lowered onto the puncturing member 70 as shown in FIGS. 4 and 5. The container 12 will be punctured such that, when the container 12 is lifted up from the puncturing member 70, any particulate matter 13 therein will be dispensed through the punctured opening into the tank 18.

When dispensing is completed, the present invention may again be secured to the loader bucket 16 via the bucket attachment assemblies 50, 60 and lifted up from the tank 18 before being moved to another location for further usage or storage.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A container puncturing device, comprising:

a cross bar;

a first tank attachment assembly secured adjacent to a first end of said cross bar;

a second tank attachment assembly secured adjacent to a second end of said cross bar, wherein said first tank attachment assembly and said second tank attachment assembly are each adapted to be secured over a respective sidewall of a tank;

a puncturing member secured to said cross bar;

a first bucket attachment assembly secured to said cross bar between said first tank attachment assembly and said puncturing member; and a second bucket attachment assembly secured to said cross bar between said puncturing member and said second tank attachment assembly, wherein said first bucket attachment assembly and said second bucket attachment assembly are each adapted to be secured to a loader bucket.

2. The container puncturing device of claim 1, wherein said first tank attachment assembly is movably secured to said cross bar.

3. The container puncturing device of claim 2, wherein said second tank attachment assembly is movably secured to said cross bar.

4. The container puncturing device of claim 1, wherein said first bucket attachment assembly is movably secured to said cross bar.

5. The container puncturing device of claim 4, wherein said second bucket attachment assembly is movably secured to said cross bar.

6. The container puncturing device of claim 1, wherein said puncturing member is movably secured to said cross bar.

7. The container puncturing device of claim 1, further comprising a first adjustment member securing said first tank attachment assembly to said cross bar and a second adjustment member securing said second tank attachment assembly to said cross bar.

8. The container puncturing device of claim 1, further comprising a first attachment bracket securing said first bucket attachment assembly to said cross bar and a second attachment bracket securing said second bucket attachment assembly to said cross bar.

9. The container puncturing device of claim 1, further comprising an attachment bracket securing said puncturing member to said cross bar.

10. The container puncturing device of claim 1, wherein said cross bar, said first tank attachment assembly, said second tank attachment assembly, said first bucket attachment assembly, said second bucket attachment assembly and said puncturing member are each integrally formed of a unitary structure.

11. A container puncturing device, comprising:

a cross bar;

a first tank attachment assembly removably secured adjacent to a first end of said cross bar by at least one attachment member;

a second tank attachment assembly removably secured adjacent to a second end of said cross bar by at least one attachment member, wherein said first tank attachment assembly and said second tank attachment assembly are each adapted to be secured over a respective sidewall of a tank;

a puncturing member removably secured to said cross bar by an attachment bracket;

a first bucket attachment assembly removably secured to said cross bar between said first tank attachment assembly and said puncturing member by an attachment bracket; and a second bucket attachment assembly removably secured to said cross bar between said puncturing member and said second tank attachment assembly by an attachment bracket, wherein said first bucket attachment assembly and said second bucket attachment assembly are each adapted to be secured to a loader bucket.

12. The container puncturing device of claim 11, wherein said first tank attachment assembly is comprised of a first side member and a second side member positioned parallel with respect to each other to define a first channel.

13. The container puncturing device of claim 12, wherein said second tank attachment assembly is comprised of a first side member and a second side member positioned parallel with respect to each other to define a second channel.

14. The container puncturing device of claim 11, further comprising a first cross member linking a first end of said first side member of said first tank attachment assembly to a first end of said second side member of said first tank attachment assembly and a second cross member linking a second end of said first side member of said first tank attachment assembly to a second end of said second side member of said first tank attachment assembly.

15. The container puncturing device of claim 12, wherein said first bucket attachment assembly includes a first fork tine receiver and said second bucket attachment assembly includes a second fork tine receiver.

16. The container puncturing device of claim 15, wherein said first fork tine receiver includes a front opening and wherein said second fork tine receiver includes a front opening.

17. The container puncturing device of claim 12, wherein said puncturing member is comprised of a plurality of blades positioned to form a single point at an upper end thereof.

18. The container puncturing device of claim 12, wherein said first bucket attachment assembly includes a locking assembly.

19. The container puncturing device of claim 18, wherein said locking assembly is comprised of a chain, wherein a first end of said chain is secured to said first bucket attachment assembly and wherein a second end of said chain is secured to a locking pin.

20. A container puncturing device, comprising:

a cross bar;

a first tank attachment assembly removably secured adjacent to a first end of said cross bar by at least one attachment member, wherein said first tank attachment assembly is comprised of a first side member and a second side member positioned parallel with respect to each other to define a first channel;

a second tank attachment assembly removably secured adjacent to a second end of said cross bar by at least one attachment member, wherein said first tank attachment assembly and said second tank attachment assembly are each adapted to be secured over a respective sidewall of a tank, wherein said second tank attachment assembly is comprised of a first side member and a second side member positioned parallel with respect to each other to define a second channel;

a puncturing member removably secured to said cross bar by an attachment bracket;

a first bucket attachment assembly removably secured to said cross bar between said first tank attachment assembly and said puncturing member by an attachment bracket;

a second bucket attachment assembly removably secured to said cross bar between said puncturing member and said second tank attachment assembly by an attachment bracket, wherein said first bucket attachment assembly and said second bucket attachment assembly are each adapted to be secured to a loader bucket;

wherein said first bucket attachment assembly includes a first fork tine receiver and said second bucket attachment assembly includes a second fork tine receiver, wherein said first fork tine receiver includes a front opening and wherein said second fork tine receiver includes a front opening;

a first cross member linking a first end of said first side member of said first tank attachment assembly to a first end of said second side member of said first tank attachment assembly; and a second cross member linking a second end of said first side member of said first tank attachment assembly to a second end of said second side member of said first tank attachment assembly.

* * * * *